US011292687B2

(12) United States Patent
Goto et al.

(10) Patent No.: US 11,292,687 B2
(45) Date of Patent: Apr. 5, 2022

(54) IMAGE FORMING APPARATUS

(71) Applicant: FUJIFILM Business Innovation Corp., Tokyo (JP)

(72) Inventors: Yasunobu Goto, Kanagawa (JP); Ryuga Oishi, Kanagawa (JP); Takuyoshi Kimura, Kanagawa (JP); Takehiko Koizumi, Kanagawa (JP); Natsumi Nakata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 65 days.

(21) Appl. No.: 16/836,940

(22) Filed: Apr. 1, 2020

(65) Prior Publication Data

US 2021/0094783 A1 Apr. 1, 2021

(30) Foreign Application Priority Data

Oct. 1, 2019 (JP) ..... JP2019-181141

(51) Int. Cl.
*B65H 29/22* (2006.01)
*B65H 15/00* (2006.01)
(Continued)

(52) U.S. Cl.
CPC ..... *B65H 29/22* (2013.01); *B65H 1/266* (2013.01); *B65H 15/004* (2020.08); *B65H 85/00* (2013.01); *G03G 15/6502* (2013.01); *B65H 2301/33312* (2013.01); *B65H 2301/442* (2013.01); *B65H 2301/4421* (2013.01); *B65H 2404/561* (2013.01); *B65H 2404/732* (2013.01); *B65H 2404/733* (2013.01); *B65H 2405/31* (2013.01);
(Continued)

(58) Field of Classification Search
CPC ..... B65H 2404/732; B65H 15/004; B65H 2601/11; B65H 2601/111; B65H 2404/561; B65H 2405/31; B65H 1/266; B65H 85/00; B65H 2511/528; B65H 29/22; G03G 2221/1675; G03G 2215/00552
See application file for complete search history.

(56) References Cited

U.S. PATENT DOCUMENTS 8,899,578 B2 * 12/2014 Tomatsu ..... B65H 85/00 271/186
9,056,745 B2 * 6/2015 Harada ..... B65H 1/266
(Continued)

FOREIGN PATENT DOCUMENTS

JP 2004035129 2/2004
JP 2011-241012 12/2011

*Primary Examiner* — Jeremy R Severson
(74) *Attorney, Agent, or Firm* — JCIPRNET

(57) ABSTRACT

An image forming apparatus includes a drawer unit, a sheet inverting unit, a sheet guide plate, and a projection. The drawer unit is drawable from an apparatus body. The sheet inverting unit is disposed in the apparatus body, and pulls a sheet into a lower portion of the drawer unit to invert the sheet. The sheet guide plate is disposed on the sheet inverting unit to face the drawer unit, and includes a recess extending in a pull-out direction of the drawer unit that crosses a direction in which the sheet is transported. The projection protrudes toward the recess from a portion of a lower surface of the drawer unit facing the sheet guide plate near a pull-out start point in the pull-out direction and on a rear of a transport area of the sheet.

11 Claims, 13 Drawing Sheets

(51) Int. Cl.

| | |
|---|---|
| ***B65H 85/00*** | (2006.01) |
| ***G03G 15/00*** | (2006.01) |
| ***B65H 1/26*** | (2006.01) |
| *G03G 15/23* | (2006.01) |

(52) U.S. Cl.
CPC ..... *B65H 2601/11* (2013.01); *B65H 2801/06* (2013.01); *G03G 15/234* (2013.01)

(56) References Cited

U.S. PATENT DOCUMENTS

| | | | | |
|---|---|---|---|---|
| 9,290,340 | B2 * | 3/2016 | Yamamoto | G03G 15/6511 |
| 9,302,884 | B2 * | 4/2016 | Sugiura | B65H 85/00 |
| 2014/0291929 | A1 * | 10/2014 | Nguyen | B65H 1/266 271/274 |
| 2021/0107306 | A1 * | 4/2021 | Kimura | B65H 85/00 |

* cited by examiner

IMAGE FORMING APPARATUS

CROSS-REFERENCE TO RELATED APPLICATIONS

This application is based on and claims priority under 35 USC 119 from Japanese Patent Application No. 2019-181141 filed Oct. 1, 2019.

BACKGROUND

(i) Technical Field

The present disclosure relates to an image forming apparatus.

(ii) Related Art

An image forming apparatus that includes a body and a drawer unit drawable from the body is known. The image forming apparatus has a sheet transport path structure in which a transport path member of the body forming a sheet transport path and a transport path member of the drawer unit are separable. The image forming apparatus forms an image on a sheet transported along the sheet transport path. The sheet transport path structure includes a transport path member of the body that restricts a movement of one side of a sheet to a predetermined direction, a transport path member of the drawer unit facing the transport path member and slidably assembled with the transport path member to restrict a movement of another side of a sheet while having a predetermined distance between itself and the transport path member, and a cleaning mechanism disposed at a sliding start point of the transport path member of the drawer unit. The cleaning mechanism includes a cleaning member longer than or equal to a predetermined length from an end of the transport path member of the drawer unit to an end of the transport path member of the body facing the end. When the drawer unit is pulled out or attached, a distal end of the cleaning member slides over the transport path member of the body while being in contact with the transport path member (Japanese Unexamined Patent Application Publication No. 2011-241012).

An image forming apparatus that includes a sheet tray, an apparatus body, a sheet inverting unit, a pulled-in sheet container, and a pushing unit is known. The sheet tray accommodates sheets subjected to image formation. The apparatus body removably accommodates the sheet tray, and has a jam removal port on a side from which the sheet tray is pulled out and below a tray holding space. The sheet inverting unit is formed in the apparatus body to pull in sheets downward to invert the sheets. The pulled-in sheet container is formed at the lowermost portion in the apparatus body substantially horizontally to be continuous with the jam removal port to accommodate sheets pulled in downward by the sheet inverting unit. The pushing unit moves in the pulled-in sheet container toward the pull-out side of the sheet tray in association with a pull-out operation of the sheet tray, and pushes a jammed sheet out through the jam removal port while being in contact with the jammed sheet in the pulled-in sheet container during this movement (Japanese Unexamined Patent Application Publication No. 2004-35129).

SUMMARY

Aspects of non-limiting embodiments of the present disclosure relate to reliable removal of sheets remaining on a transport path and cleaning of the transport path.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming apparatus according to an aspect of the present disclosure that includes a drawer unit, a sheet inverting unit, a sheet guide plate, and a projection. The drawer unit is drawable from an apparatus body. The sheet inverting unit is disposed in the apparatus body, and pulls a sheet into a lower portion of the drawer unit to invert the sheet. The sheet guide plate is disposed on the sheet inverting unit to face the drawer unit, and includes a recess extending in a pull-out direction of the drawer unit that crosses a direction in which the sheet is transported. The projection protrudes toward the recess from a portion of a lower surface of the drawer unit facing the sheet guide plate near a pull-out start point in the pull-out direction and on a rear of a transport area of the sheet.

BRIEF DESCRIPTION OF THE DRAWINGS

Exemplary embodiments of the present disclosure will be described in detail based on the following figures, wherein.

DETAILED DESCRIPTION

Figure 1:
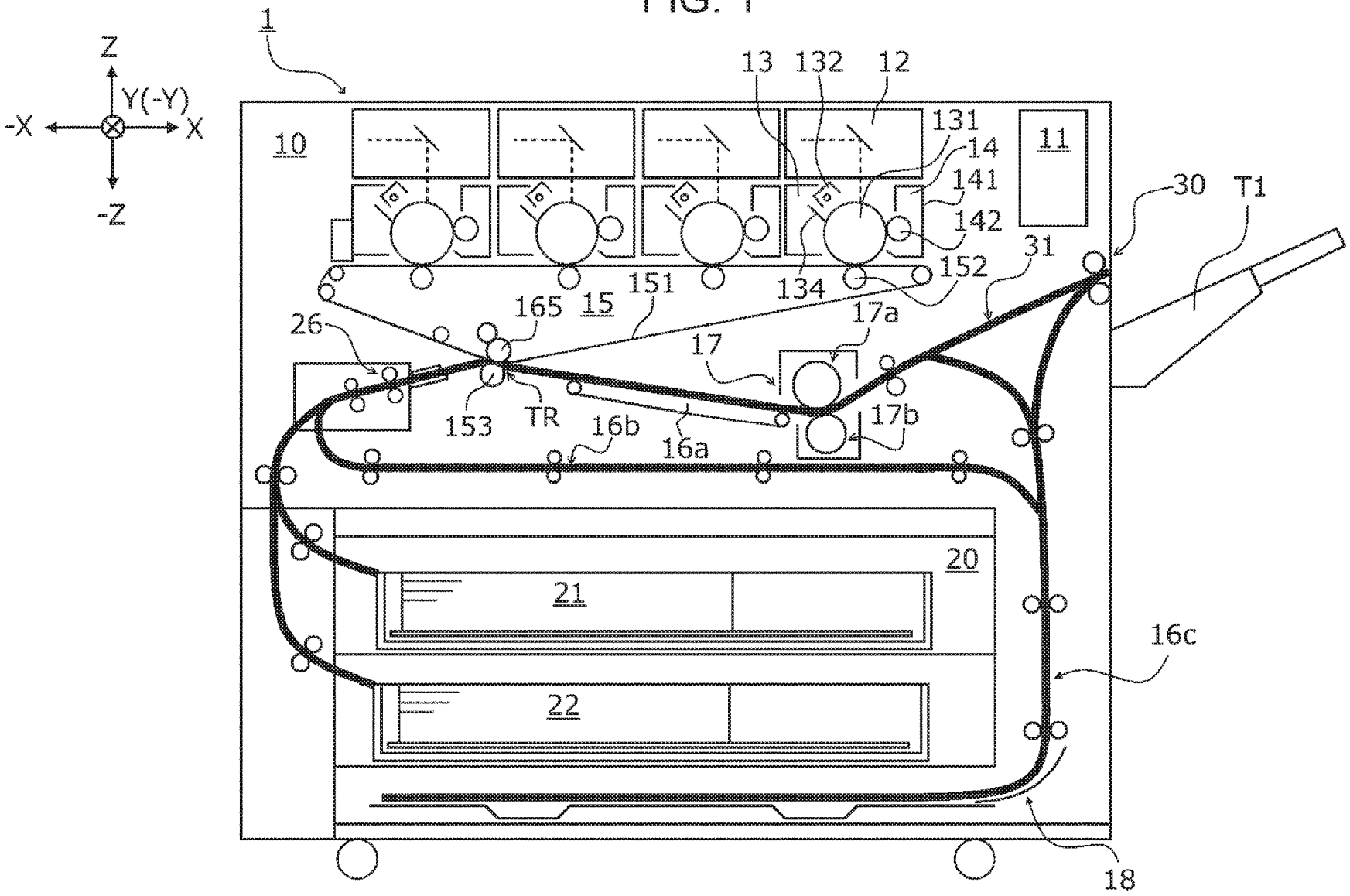
FIG. 1 is a schematic cross-sectional view of an example of a schematic structure of an image forming apparatus.

With reference to the drawings, the present disclosure will be further described below in detail using exemplary embodiments and specific examples. The present disclosure, however, is not limited to these exemplary embodiments and specifications.

In the following description with reference to the drawings, it should be noted that the drawings are schematic, the dimensional ratios throughout the drawings are different from the actual ones, and components other than needed are omitted as appropriate for ease of understanding.

For ease of understanding the following description, the front-rear direction is referred to as an X-axis direction, the left-right direction is referred to as a Y-axis direction, and the vertical direction is referred to as a Z-axis direction in the drawings.

First Exemplary Embodiment (1) Entire Structure and Operation of Image Forming Apparatus (1.1) Entire Structure of Image Forming Apparatus FIG. 1 is a schematic cross-sectional view of an example of a schematic structure of an image forming apparatus 1 according to the present exemplary embodiment.

The image forming apparatus 1 includes an image forming portion 10, a sheet feeder 20 attached to a lower portion of the image forming portion 10, and a sheet discharge portion 30 disposed at an end of the image forming portion 10 and to which printed sheets P are discharged.

The image forming portion 10 includes a system controller (not illustrated), an exposure device 12, a photoconductor unit 13, a developing device 14, a transfer device 15, a sheet transport device 16*a*, and a fixing device 17. The image forming portion 10 forms a toner image on a sheet P fed from the sheet feeder 20 from image information received from an image processing portion 40.

The sheet feeder 20, including sheet trays 21 and 22 as an example of drawer units, is disposed on the bottom of the image forming portion 10 to feed sheets to the image forming portion 10. Specifically, the sheet feeder 20 includes the multiple sheet trays 21 and 22, which accommodate sheets P of different types (different in, for example, material, thickness, size, or grain orientation) of recording media, to feed sheets P picked up from either one of the multiple sheet trays 21 and 22 to the image forming portion 10. The sheet trays 21 and 22 are drawable to an operator (in the −Y direction), and pulled toward the operator to be replenished with sheets P.

The sheet discharge portion 30 discharges sheets P to which images are output by the image forming portion 10 and fixed by the fixing device 17. The sheet discharge portion 30 thus includes a transport path 31, along which sheets P subjected to fixing are transported, and a discharged sheet container T1, to which the sheets P are discharged. The sheet discharge portion 30 also includes a sheet inverting unit 18, which inverts the sheets P and feeds the sheets P to a sheet transport device 16*b* for outputting images on both sides of the sheets P. The sheet discharge portion 30 may have a function of performing postprocessing on a sheet bundle output from the image forming portion 10, such as cutting or stapling.

(1.2) Structure and Operation of Image Forming Portion

In the above image forming apparatus 1, a sheet P picked up from one of sheet mount portions of the sheet feeder 20 designated for each print job at the timing of image formation is fed to the image forming portion 10.

The photoconductor units 13 are arranged side by side below the exposure devices 12, and each include a photoconductor drum 131, serving as an image carrier driven to rotate. In the rotation direction of each photoconductor drum 131, a charging device 132, the exposure device 12, the developing device 14, a first-transfer roller 152, and a cleaning blade 134 are arranged.

Each developing device 14 includes a development housing 141, which accommodates a developer. The development housing 141 accommodates a development roller 142 disposed to face the photoconductor drum 131.

The developing devices 14 have substantially the same structure except for developers accommodated in the development housings 141 to form toner images of yellow (Y), magenta (M), cyan (C), and black (K).

The surface of the rotating photoconductor drum 131 is charged by the charging device 132 to have electrostatic latent images formed with latent-image-forming light emitted from the exposure device 12. Electrostatic latent images formed on the photoconductor drum 131 are developed into toner images by the development roller 142.

The transfer device 15 includes an intermediate transfer belt 151, the first-transfer rollers 152, and a second-transfer roller 153. The intermediate transfer belt 151 receives superposed toner images of respective colors formed by the photoconductor drums 131 of the respective photoconductor units 13. The first-transfer rollers 152 sequentially transfer (first-transfer) the toner images of different colors formed by the photoconductor units 13 to the intermediate transfer belt 151. The second-transfer roller 153 collectively transfers (second-transfers) the toner images of different colors that have been transferred to the intermediate transfer belt 151 in a superposed manner to sheets P, which are recording medium.

The toner images of different colors formed on the photoconductor drums 131 of the photoconductor units 13 are sequentially electrostatically transferred (first-transferred) onto the intermediate transfer belt 151 by the first-transfer rollers 152 to which a predetermined first transfer voltage is applied from a power supply (not illustrated) controlled by the system controller at first transfer portions where the intermediate transfer belt 151 and the photoconductor drums 131 are in contact, to form a superposed toner image from toner of different colors.

Along with the movement of the intermediate transfer belt 151, the superposed toner image on the intermediate transfer belt 151 is transported to a second transfer portion TR at which the second-transfer roller 153 is pressed against a back-up roller 165 with the intermediate transfer belt 151 interposed therebetween.

At the timing when a superposed toner image is transported to the second transfer portion TR, a sheet P is fed to the second transfer portion TR from the sheet feeder 20. A predetermined second transfer voltage is applied from a power supply (not illustrated) controlled by a system controller 11 to the back-up roller 165, facing the second-transfer roller 153 with the intermediate transfer belt 151 interposed therebetween, to collectively transfer a multilayer toner image on the intermediate transfer belt 151 to the sheet P.

Toner remaining on the surface of each photoconductor drum 131 is removed by the corresponding cleaning blade 134, and the surface of the photoconductor drum 131 is recharged by the corresponding charging device 132.

The sheets P to which toner images have been transferred by the transfer device 15 are transported to the fixing device 17 via the sheet transport device 16*a* while having the toner images unfixed. The sheets P transported to the fixing device 17 have the toner images fixed by heating and pressing operations with a pair of a heating module 17*a* and a pressing module 17*b*.

The sheets P subjected to fixing are stacked on the discharged sheet container T1. To output images on both surfaces of the sheets P, the sheets P are inverted by the sheet inverting unit 18, and fed to the second transfer portion TR of the image forming portion 10 again. After the transfer of the toner images and fixing of the transferred images, the sheets P are fed to the sheet discharge portion 30. The sheets P fed to the sheet discharge portion 30 are subjected to postprocessing such as cutting or stapling, as appropriate.

(2) Sheet Inverting Unit

Figure 2A:
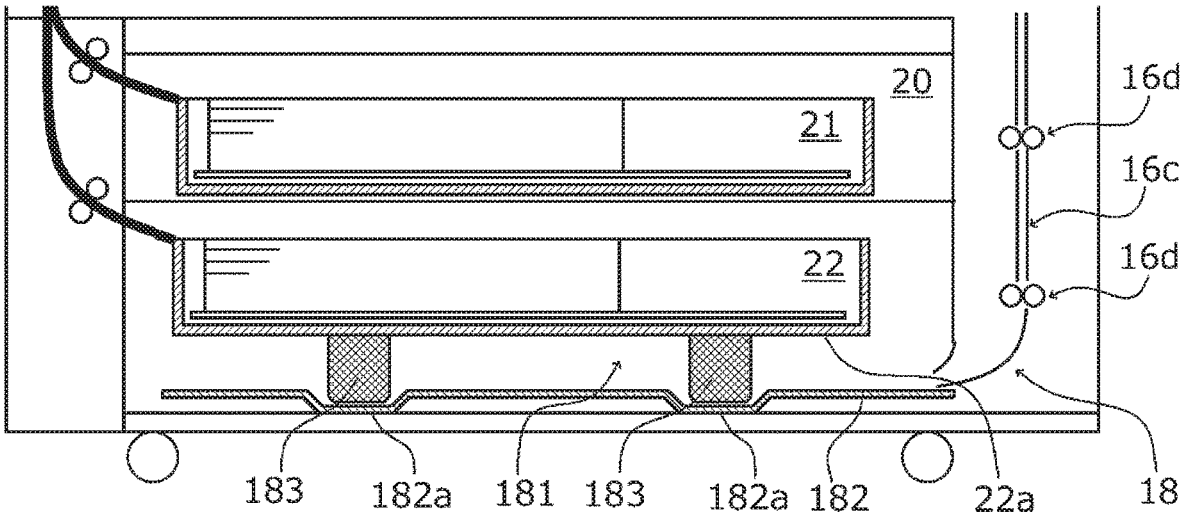
FIG. 2A is a schematic cross-sectional view of a sheet inverting unit and sheet trays viewed from the front.
Figure 2B:
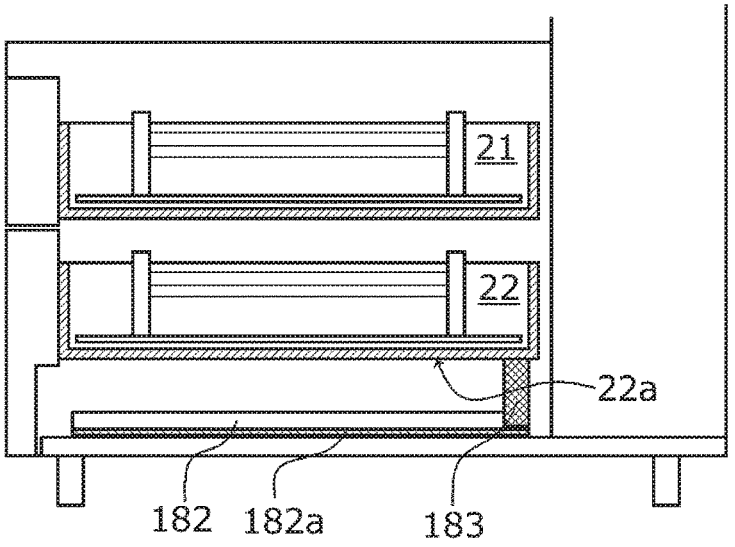
FIG. 2B is a schematic cross-sectional view of the sheet inverting unit and the sheet trays viewed from the side.
Figure 3:
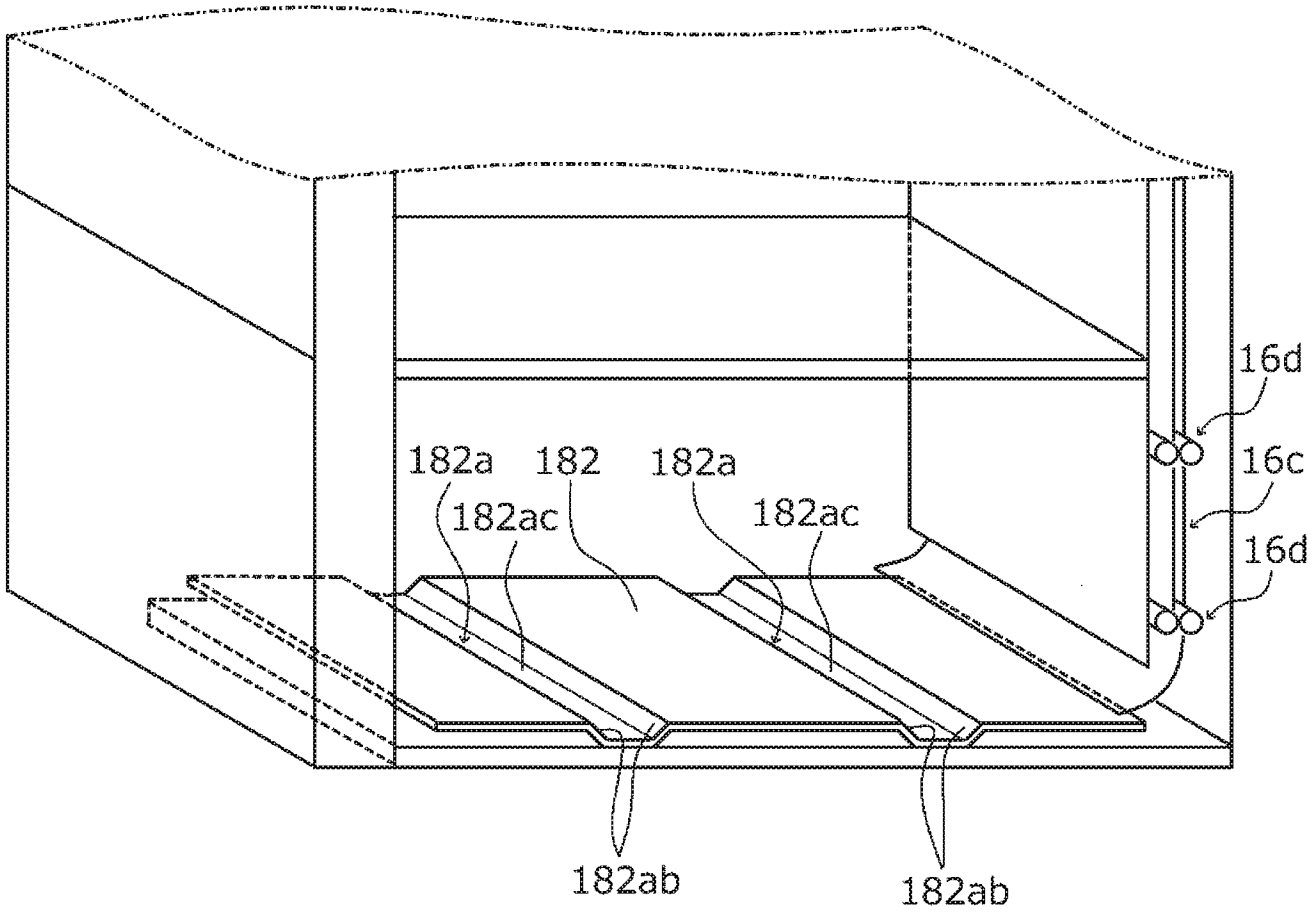
FIG. 3 is a perspective view of the inside of the sheet inverting unit without illustrating the sheet trays.
Figure 4:
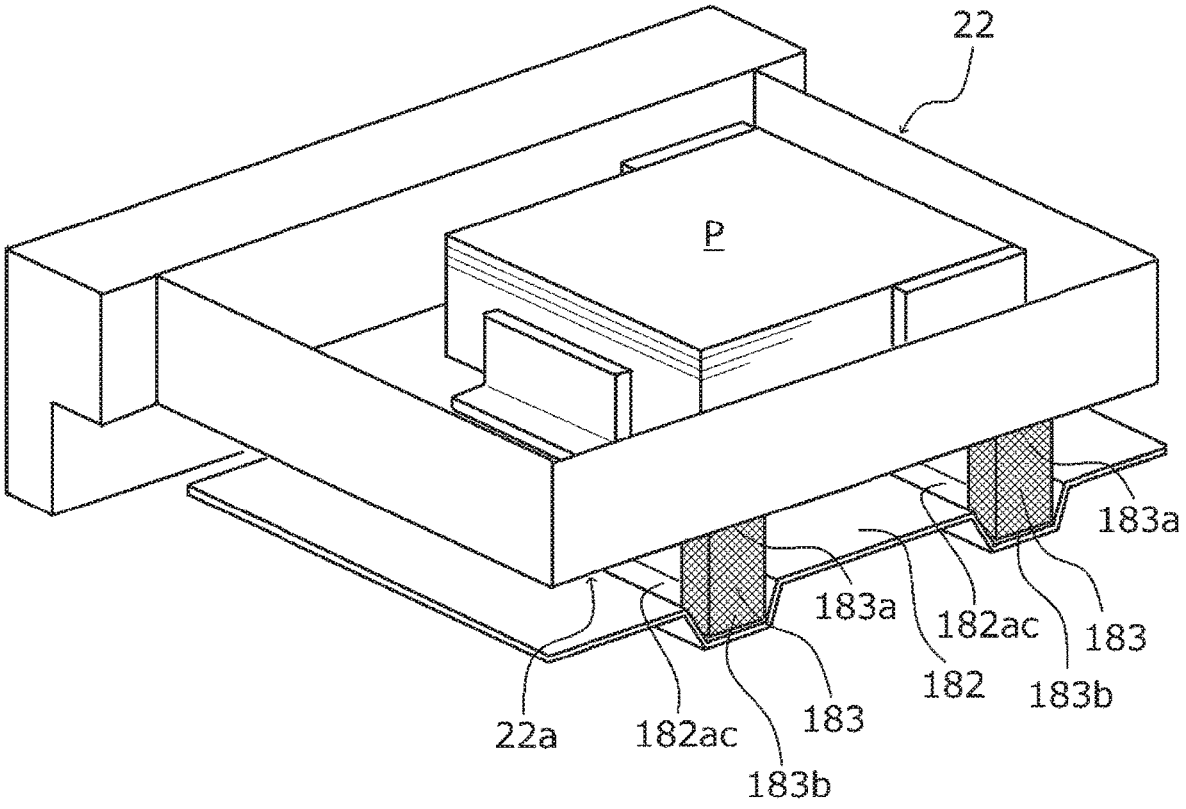
FIG. 4 is a perspective view of a sheet guide plate and a sheet tray viewed from the rear side of the apparatus.
Figure 5A:
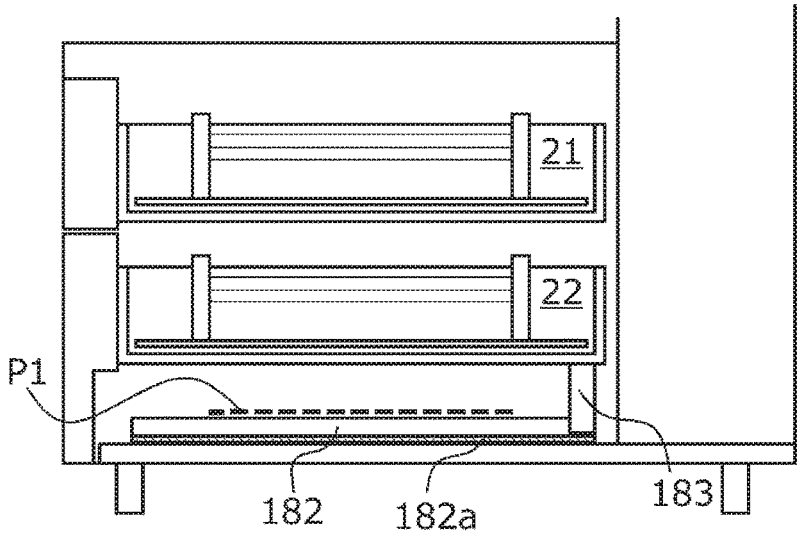
FIGS. 5A, 5B, and 5C are schematic cross-sectional views of the sheet inverting unit, viewed from the side, subjected to removal of remaining sheets.
Figure 5B:
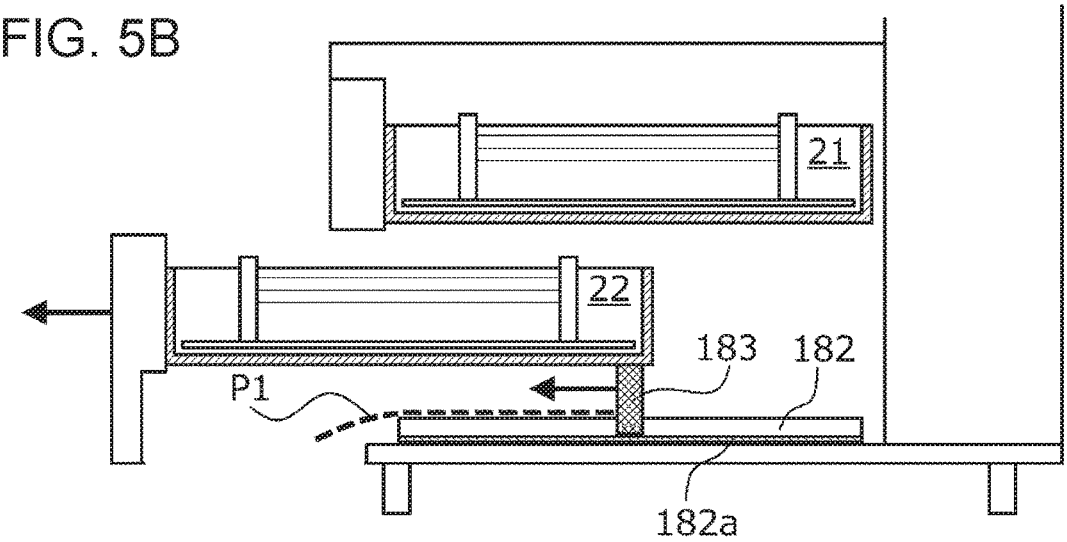
Figure 5C:
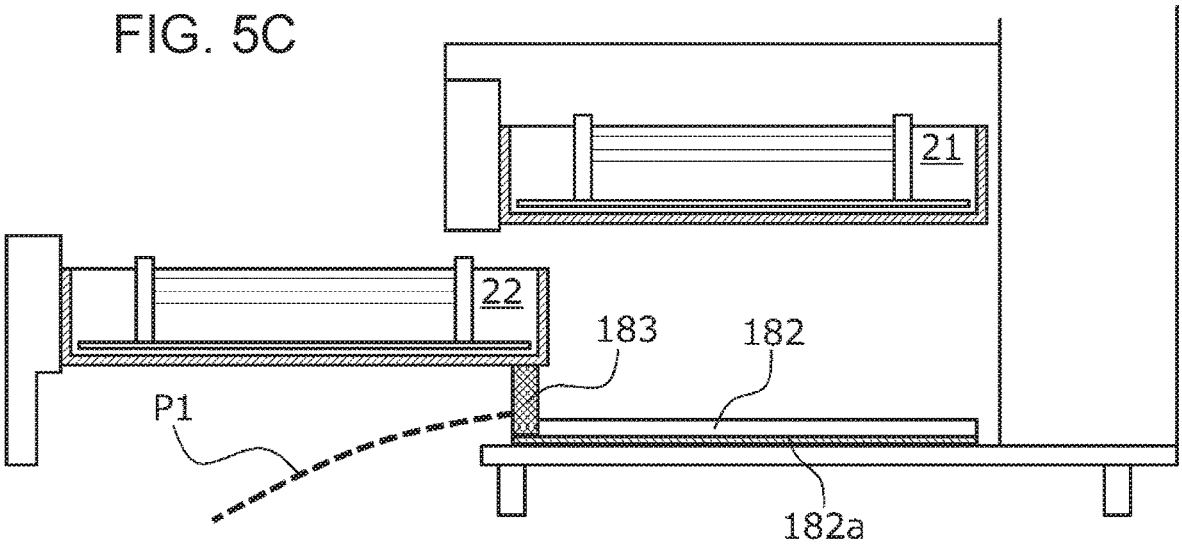
Figure 13A:
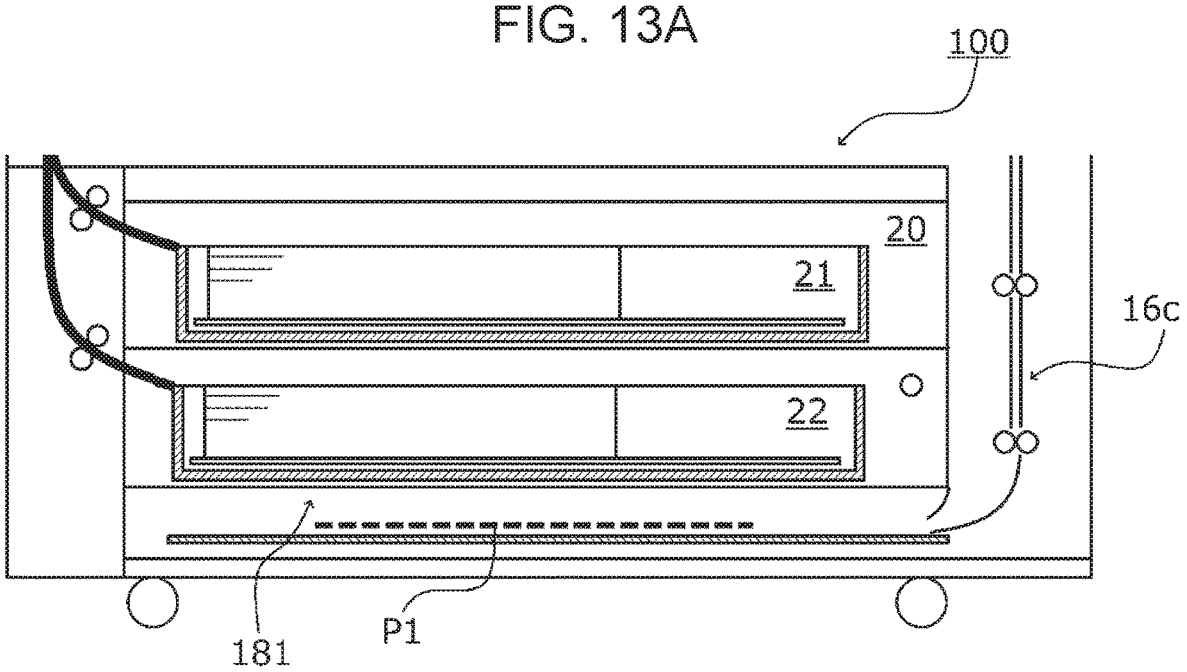
FIGS. 13A and 13B are schematic cross-sectional views of an image forming apparatus according to a comparative example subjected to removal of a remaining sheet.
Figure 13B:
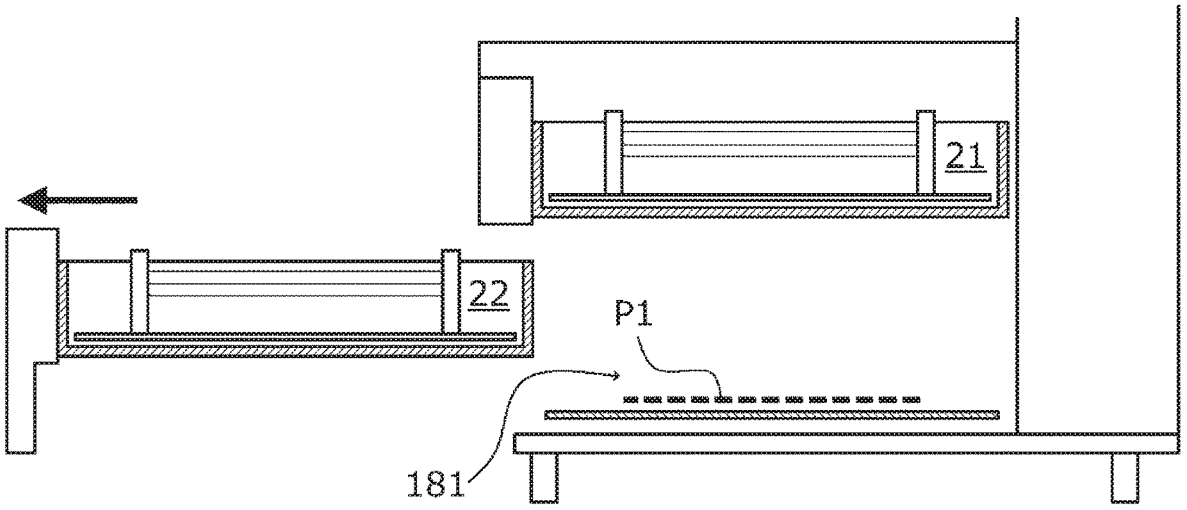

FIG. 2A is a schematic cross-sectional view of the sheet inverting unit 18 and the sheet trays 21 and 22 viewed from the front, and FIG. 2B is a schematic cross-sectional view of the sheet inverting unit 18 and the sheet trays 21 and 22 viewed from the side. FIG. 3 is a perspective view of the inside of the sheet inverting unit 18 without illustrating the sheet trays 21 and 22. FIG. 4 is a perspective view of a sheet guide plate 182 and the sheet tray 22 viewed from the rear side of the apparatus. FIGS. 5A to 5C are schematic cross-sectional views of the sheet inverting unit 18 viewed from the side subjected to removal of remaining sheets. FIGS. 13A and 13B are schematic cross-sectional views of an image forming apparatus 100 according to a comparative example subjected to removal of a remaining sheet P1.

The structure of the sheet inverting unit 18 and removal of remaining sheets will be described below with reference to the drawings.

(2.1) Structure of Sheet Inverting Unit

As illustrated in FIGS. 2A and 2B, to reduce the size of the apparatus body as small as possible, the sheet inverting unit 18 of the image forming apparatus 1 according to the present exemplary embodiment includes a sheet transport path 16*c*, extending substantially perpendicular to one side in the apparatus body (sheet discharge portion 30) adjacent to the space accommodating the sheet feeder 20, and a pulled-in sheet container 181, which serves as a sheet pull-in path, disposed substantially horizontally at the lowermost portion in the apparatus body left as a dead space after the sheet trays 21 and 22 are assembled. This structure enables automatic both-side printing on long sheets by pulling long sheets into the pulled-in sheet container 181, besides normal-size sheets, and transporting the long sheets in an inverted manner.

In the image forming apparatus, when the sheet inverting unit 18 inverts a sheet P, the sheet P needs to be constantly held by reverse rollers 16*d*. If, for any reason, a sheet P of a small size, in particular, deviates from the reverse rollers 16*d*, the sheet P falls from the sheet transport path 16*c* to the pulled-in sheet container 181, and is left in the pulled-in sheet container 181 as a jammed sheet.

When an image forming operation is continued while leaving such jamming in the pulled-in sheet container 181, subsequent sheets P become caught on a remaining sheet P1 left in the pulled-in sheet container 181, and the sheets P become jammed sequentially. Thus, the remaining sheet P1 left in the pulled-in sheet container 181 after falling from the sheet transport path 16*c* needs to be immediately removed.

However, in the image forming apparatus 100 according to a comparative example illustrated in FIGS. 13A and 13B, the pulled-in sheet container 181 has an excessively narrow space, and does not allow a user to access the remaining sheet P1 left in the pulled-in sheet container 181 even after the sheet tray 22 above the pulled-in sheet container 181 is pulled toward the operator (in the -Y direction). Thus, the user fails to remove the remaining sheet P1.

Whenever a sheet P falls in the pulled-in sheet container 181, a user has to ask a maintenance worker to remove the jammed sheet. The remaining-sheet removal operation is troublesome also for the maintenance worker because he/she has to completely remove the sheet tray 22 from the apparatus body to remove the remaining sheet P1.

As illustrated in FIGS. 2A and 2B, the sheet inverting unit 18 of the image forming apparatus 1 according to the present exemplary embodiment includes the sheet transport path 16*c* and the pulled-in sheet container 181. The sheet transport path 16*c* pulls the sheets P in the direction (Z direction) substantially perpendicular to the direction sideways of the sheet feeder 20 including the sheet trays 21 and 22. The pulled-in sheet container 181 pulls the sheets P in the direction (X direction) substantially horizontal to the bottom of the sheet tray 22.

The pulled-in sheet container 181 includes the sheet guide plate 182, which faces the lowest sheet tray 22 of the sheet feeder 20 and guides the pulled-in sheets P in the horizontal direction (X direction). As illustrated in FIG. 3, the sheet guide plate 182 has recesses 182*a*, which extend in the pull-out direction (Y direction) of the sheet tray 22, which crosses the direction in which the sheets P are transported.

As illustrated in FIG. 3, each recess 182*a* has tapered portions 182*ab* to prevent the pulled-in sheets P from being jammed in the recess 182*a*.

As illustrated in FIG. 4, projections 183 protrude toward the recesses 182*a* in the sheet guide plate 182 from portions of a lower surface 22*a* of the sheet tray 22 facing the sheet guide plate 182 near the pull-out start point in the pull-out direction (−Y direction) and on the rear of a transport area of the sheets P. Each of the projections 183 has a base end 183*a* fixed to the lower surface 22*a* of the sheet tray 22, and a distal end 183*b* in substantially contact with a bottom surface 182*ac* of the corresponding recess 182*a* of the sheet guide plate 182. The projections 183 having such a structure are preferably formed from elastic foam. Particularly, desirable examples of elastic foam are polyurethane foam and silicone foam having tensile strength to prevent damages on the bottom surfaces 182*ac* of the recesses 182*a* due to abrasion or breakage of the projections 183 due to long time use.

(2.2) Removal of Remaining Sheets

When the sheets P deviate from the reverse rollers 16*d* on the sheet transport path 16*c* and fall on the pulled-in sheet container 181, the sheets P are left unremovable as a remaining sheet P1 on the sheet guide plate 182, as illustrated in FIG. 5A.

After the remaining sheet P1 is left on the sheet guide plate 182, when the sheet tray 22 is pulled toward the operator (in the −Y direction), as illustrated in FIG. 5B, the projections 183 move in the recesses 182*a* of the sheet guide plate 182 while being in contact with the end of the remaining sheet P1 in association with the pull-out operation of the sheet tray 22. Thus, the remaining sheet P1 is pushed out in the pull-out direction (−Y direction) of the apparatus body along with the movement of the projections 183, so that the remaining sheet P1 is removable without the need of removal of the sheet tray 22.

Second Exemplary Embodiment

Figure 6A:
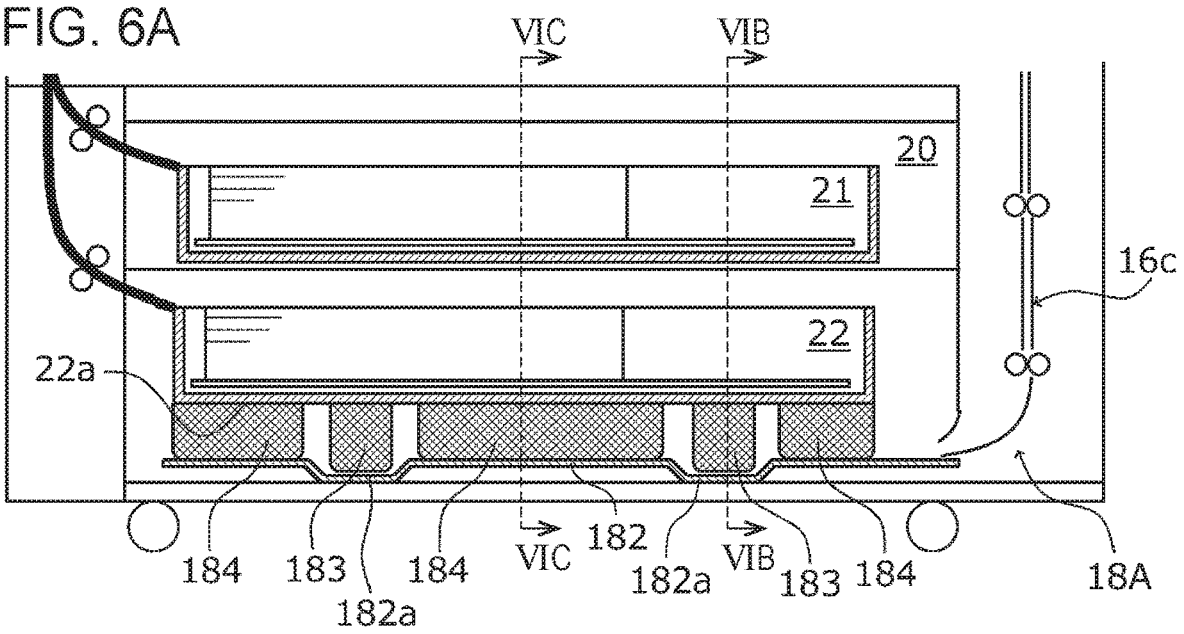
FIG. 6A is a schematic cross-sectional view of a sheet inverting unit and sheet trays according to a second exemplary embodiment viewed from the front.
Figure 6B:
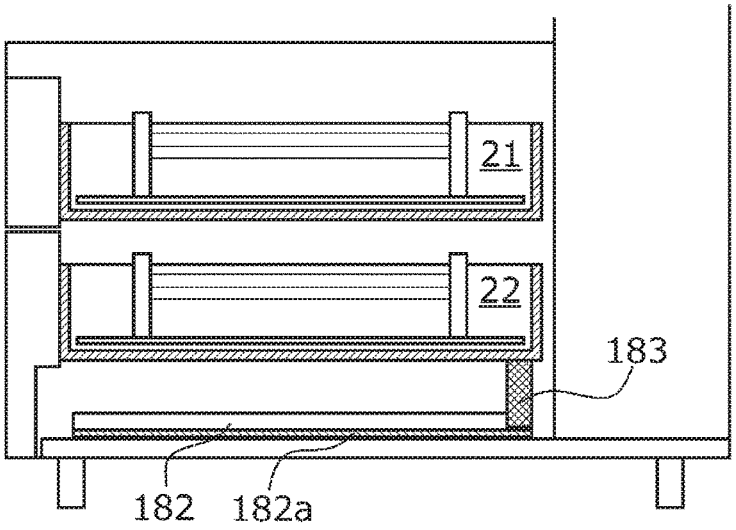
FIGS. 6B and 6C are schematic cross-sectional views of a sheet inverting unit and sheet trays viewed from the side.
Figure 6C:
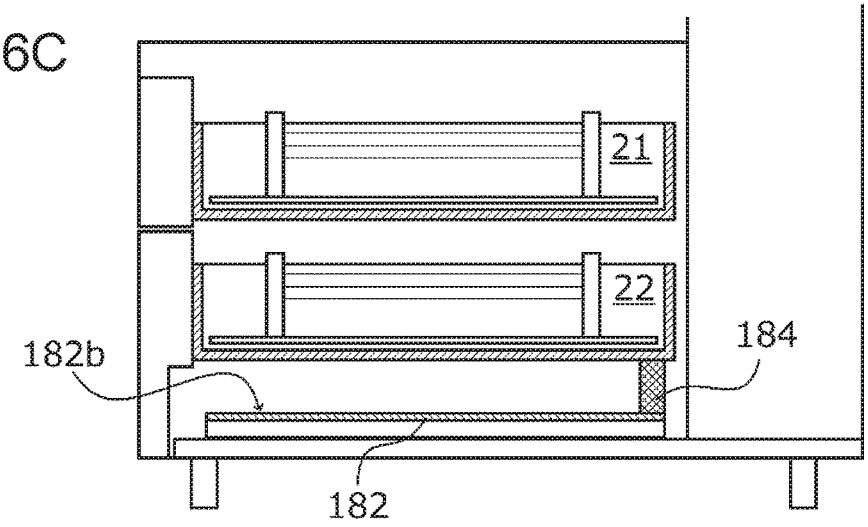
Figure 7:
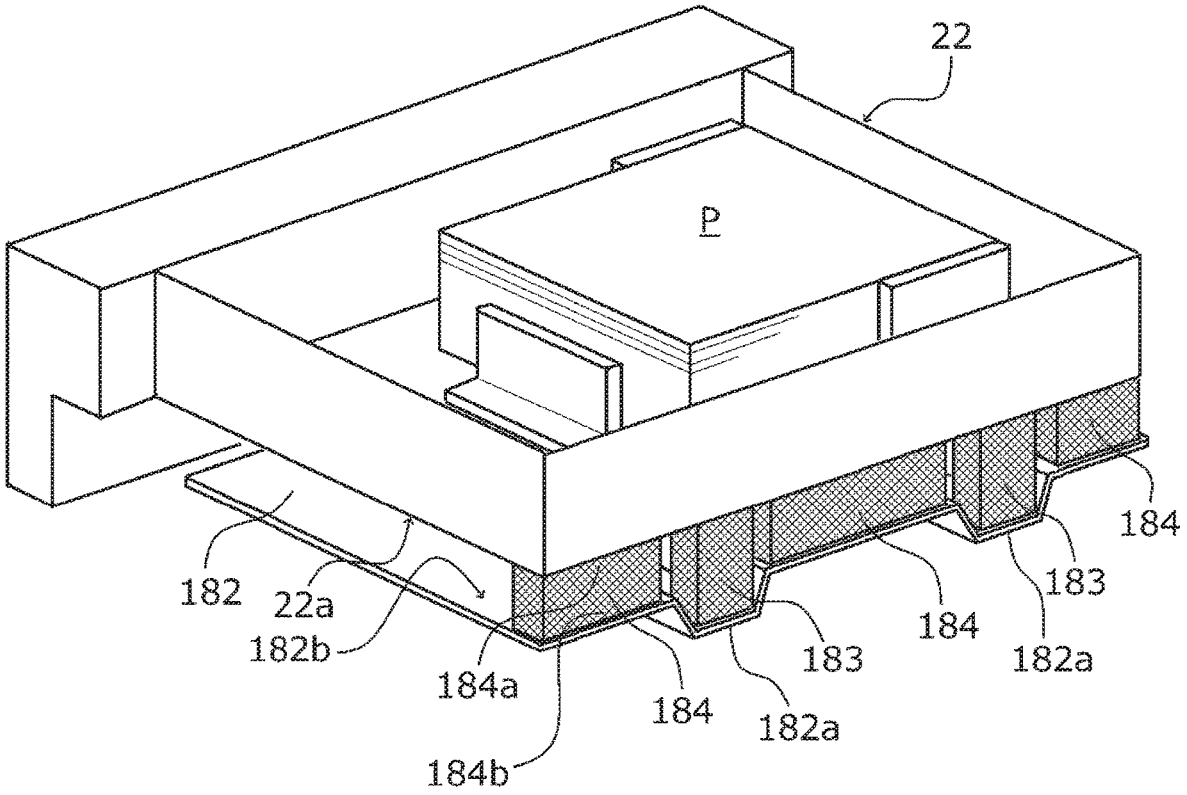
FIG. 7 is a perspective view of a sheet guide plate and a sheet tray viewed from the rear side of the apparatus.
Figure 8A:
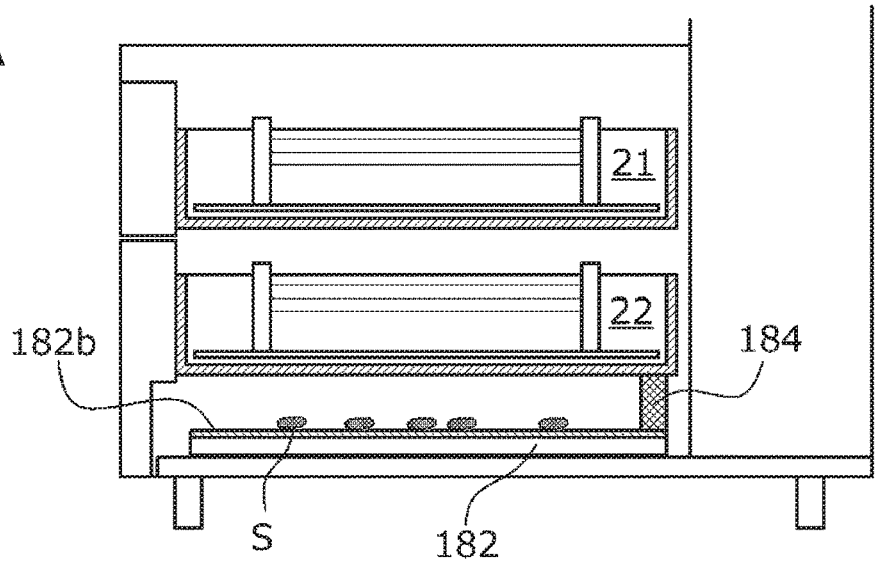
FIGS. 8A, 8B, and 8C are schematic cross-sectional views, viewed from the side, of a sheet inverting unit according to a second exemplary embodiment subjected to removal of a remaining sheet and a sheet guide plate subjected to cleaning.
Figure 8B:
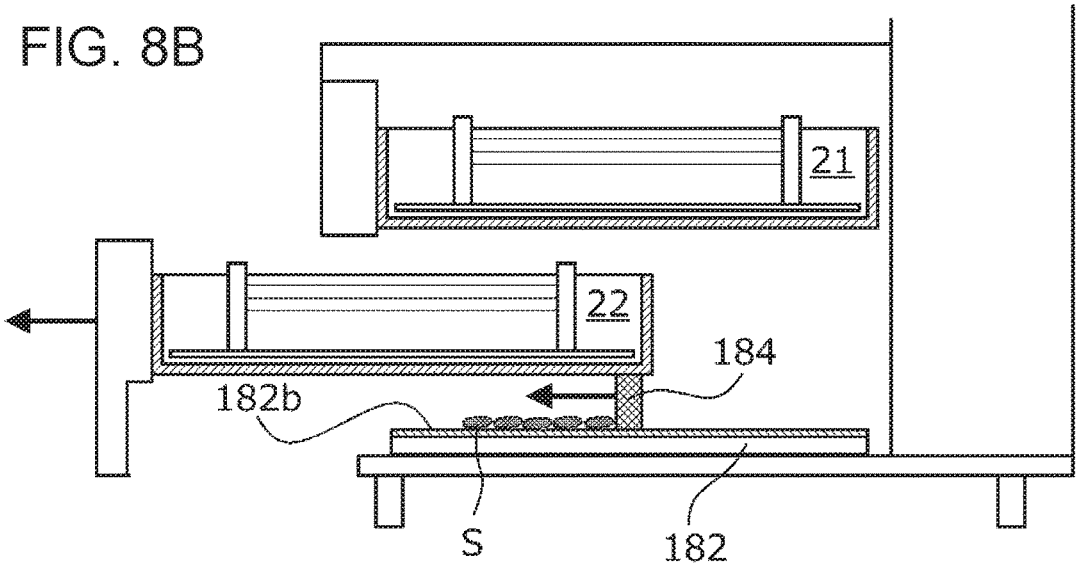
Figure 8C:
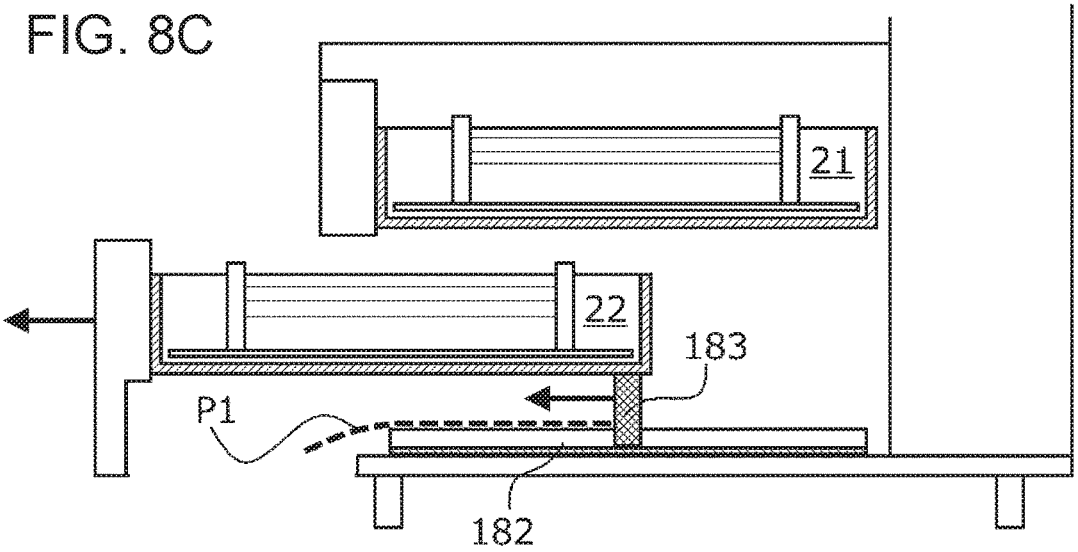

FIG. 6A is a schematic cross-sectional view of a sheet inverting unit 18A and sheet trays 21 and 22 according to a second exemplary embodiment viewed from the front, and FIGS. 6B and 6C are schematic cross-sectional views of the sheet inverting unit 18A and the sheet trays 21 and 22 viewed from the side. FIG. 7 is a perspective view of the sheet guide plate 182 and the sheet tray 22 viewed from the rear side of the apparatus. FIGS. 8A to 8C are schematic cross-sectional views, viewed from the side, of the sheet inverting unit 18A subjected to removal of the remaining sheet P1 and the sheet guide plate 182 subjected to cleaning.

Now, the structure of the sheet inverting unit 18A and cleaning of the sheet guide plate 182 will be described below with reference to the drawings.

As illustrated in FIG. 6A, the sheet inverting unit 18A of the image forming apparatus 1 according to the present exemplary embodiment includes the sheet transport path 16*c*, into which the sheets P are pulled in the direction (in the Z direction) substantially perpendicular to the direction sideways of the sheet feeder 20 including the sheet trays 21 and 22, and the pulled-in sheet container 181, into which the sheets P are pulled in the substantially horizontal direction (X direction) to accommodate the sheets P below the sheet tray 22.

The pulled-in sheet container 181 includes the sheet guide plate 182, which faces the lowermost sheet tray 22 of the sheet feeder 20 to guide the pulled-in sheets P in the horizontal direction (X direction). As in the case of the first exemplary embodiment, the sheet guide plate 182 has recesses 182*a*, which extend in the pull-out direction (Y direction) of the sheet tray 22 that crosses the transport direction of the sheets P.

As illustrated in FIG. 7, projections 183 protrude toward the recesses 182*a* in the sheet guide plate 182 from portions of a lower surface 22*a* of the sheet tray 22 facing the sheet guide plate 182 near the pull-out start point in the pull-out direction (−Y direction) and on the rear of a transport area of the sheets P.

In addition, second projections 184 protrude toward the sheet guide plate 182 from portions of the lower surface 22*a* of the sheet tray 22 facing the sheet guide plate 182 near the pull-out start point in the pull-out direction (−Y direction) and on the rear of a transport area of the sheets P.

As in the projections 183, each of the second projections 184 has a base end 184*a* fixed to the lower surface 22*a* of the sheet tray 22, and a distal end 184*b* in contact with a surface 182*b* of the sheet guide plate 182. The projections 183 and the second projections 184 having such a structure are preferably formed from elastic foam. Particularly, desirable examples of elastic foam are polyurethane foam and silicone foam to prevent damages on the sheet guide plate 182 or breakage of the projections 183 and 184 due to long time use, as the second projections 184, in particular, move relative to the surface 182*b* of the sheet guide plate 182 while being in contact with the surface 182*b* to clean the sheet guide plate 182.

As illustrated in FIG. 8A, dust S such as paper dust or dirt accumulates on the surface 182*b* of the sheet guide plate 182. As illustrated in FIG. 8B, according to the present exemplary embodiment, when the sheet tray 22 is pulled toward the operator (in the −Y direction), the second projections 184 move over the surface 182*b* of the sheet guide plate 182 while being in contact with the surface 182*b* of the sheet guide plate 182 in association with the pull-out operation of the sheet tray 22. Thus, the dust S that has accumulated on the sheet guide plate 182 is swept off in the pull-out direction (−Y direction) of the apparatus body along with the movement of the second projections 184.

Thus, the user that cleans the sheet guide plate 182 of the sheet inverting unit 18A to remove the remaining sheet P1 is prevented from becoming stained through the pull-out operation of the sheet tray 22.

When the remaining sheet P1 is left on the sheet guide plate 182, as illustrated in FIG. 8C, the sheet tray 22 is pulled toward the operator (in the −Y direction) to move the projections 183 in the recesses 182*a* of the sheet guide plate 182 while the projections 183 are in contact with the end of the remaining sheet P1 in association with the pull-out operation of the sheet tray 22. Thus, the remaining sheet P1 is pushed out in the pull-out direction (−Y direction) of the apparatus body, and thus removable without removing the sheet tray 22.

First Modification Example

Figure 9:
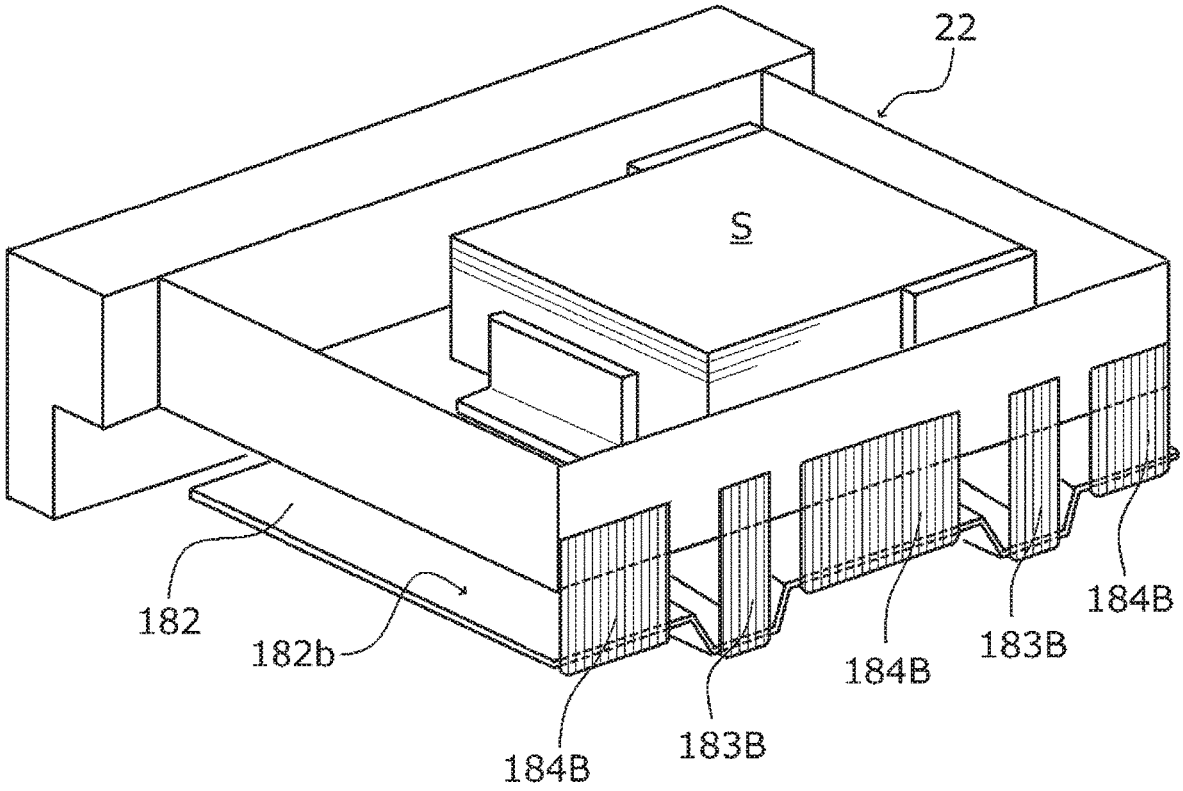
FIG. 9 is a perspective view of a sheet guide plate and a sheet tray of a sheet inverting unit according to a first modification example viewed from the rear side of the apparatus.
Figure 10A:
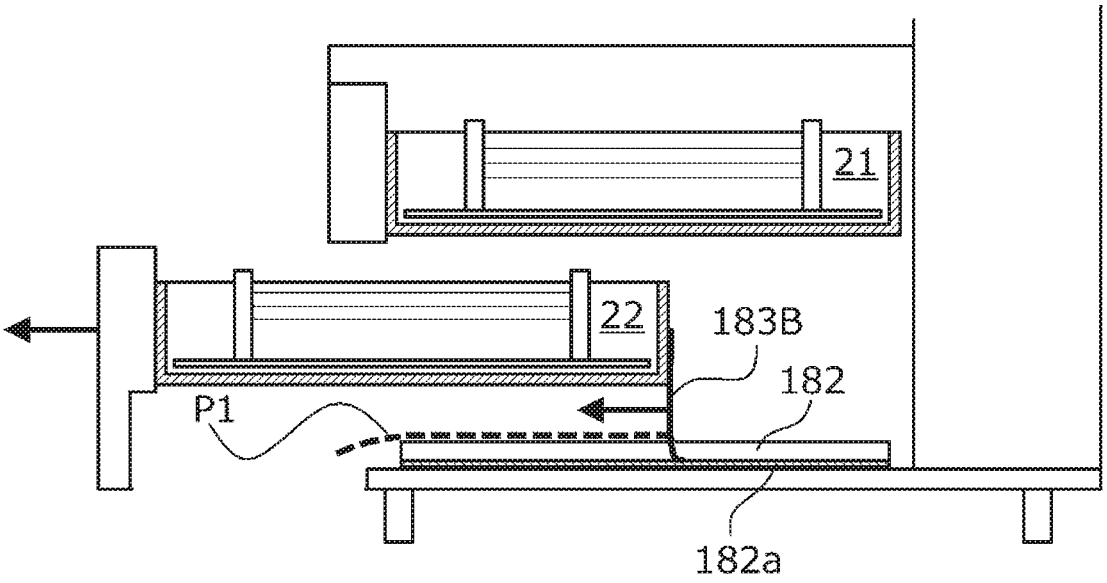
FIGS. 10A and 10B are schematic cross-sectional views, viewed from the side, of a sheet inverting unit according to a first modification example subjected to removal of a remaining sheet and a sheet guide plate subjected to cleaning.
Figure 10B:
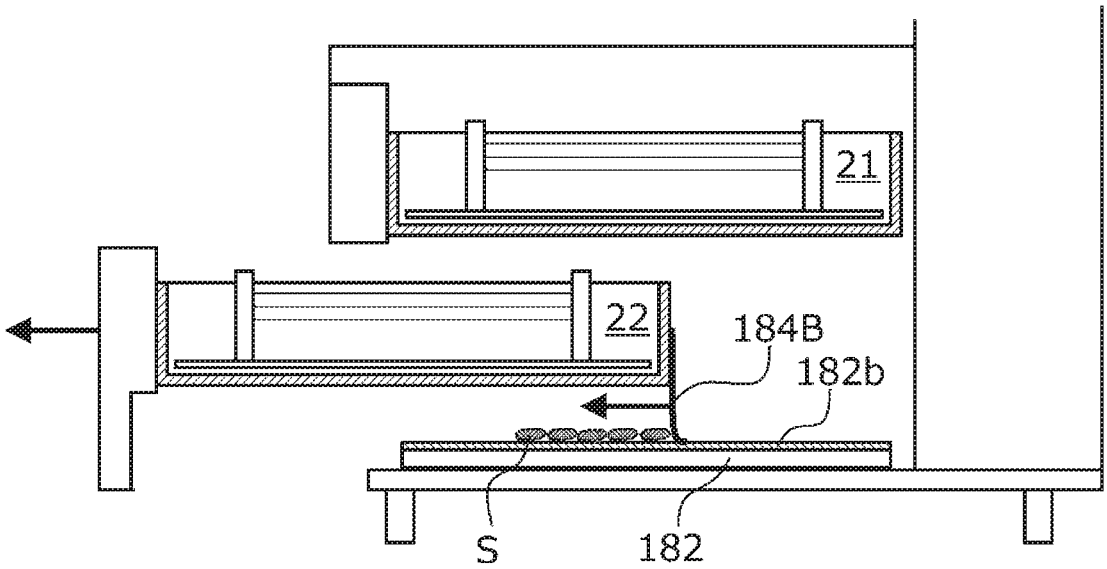

FIG. 9 is a perspective view of a sheet guide plate 182 and a sheet tray 22 of a sheet inverting unit 18B according to a first modification example viewed from the rear side of the apparatus. FIGS. 10A and 10B are schematic cross-sectional views, viewed from the side, of the sheet inverting unit 18B subjected to removal of the remaining sheet P1 and the sheet guide plate 182 subjected to cleaning.

As illustrated in FIG. 9, projections 183B and second projections 184B of the sheet inverting unit 18B according to a first modification example are formed from Mylar (registered trademark) polyester films. Preferable examples of Mylar (registered trademark) polyester films include PET films having a thickness of 0.1 to 0.2 mm. As illustrated in FIGS. 10A and 10B, such Mylar (registered trademark) polyester films enable the projections 1833 to reliably push out the remaining sheet P1 left on the sheet guide plate 182 in association with the pull-out operation of the sheet tray 22, and enable the second projections 184B to reliably sweep off the dust S accumulating on the sheet guide plate 182 in the pull-out direction (−Y direction) of the apparatus body while the second projections 184B are in contact with the surface 182*b* of the sheet guide plate 182 in the form of a wiper.

Second Modification Example

Figure 11:
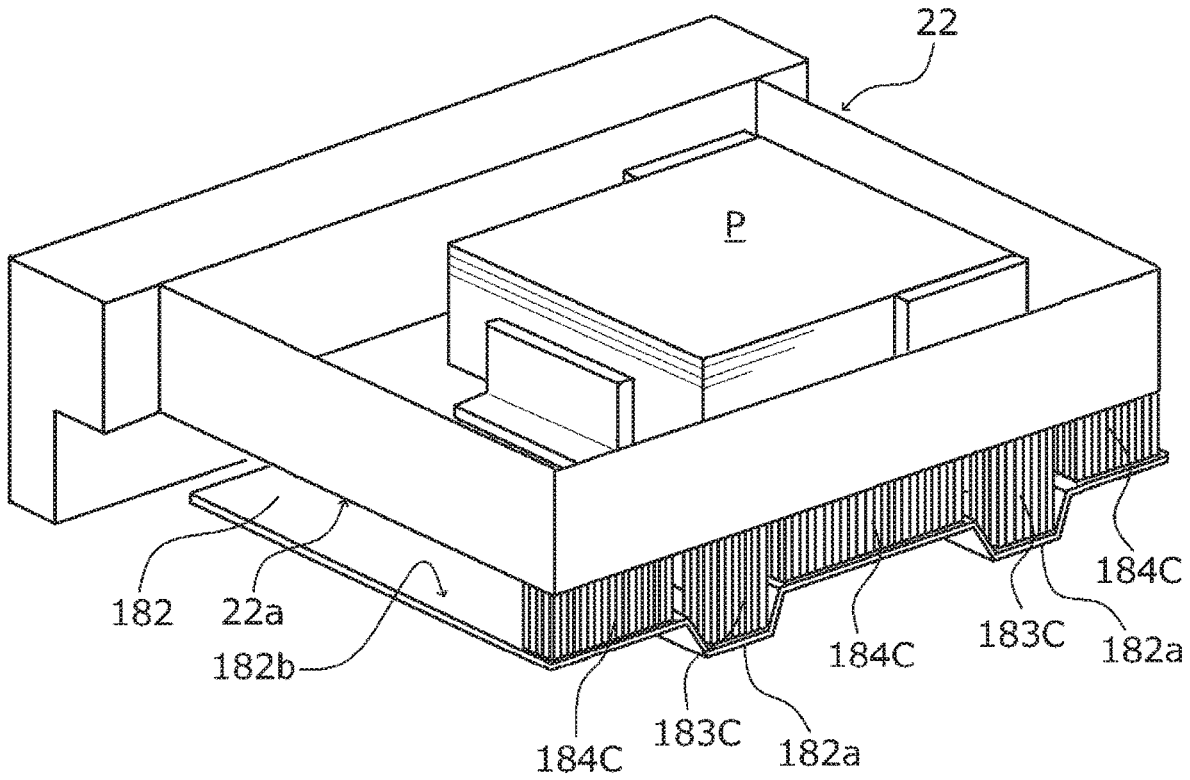
FIG. 11 is a perspective view of a sheet guide plate and a sheet tray of a sheet inverting unit according to a second modification example viewed from the rear side of the apparatus.
Figure 12A:
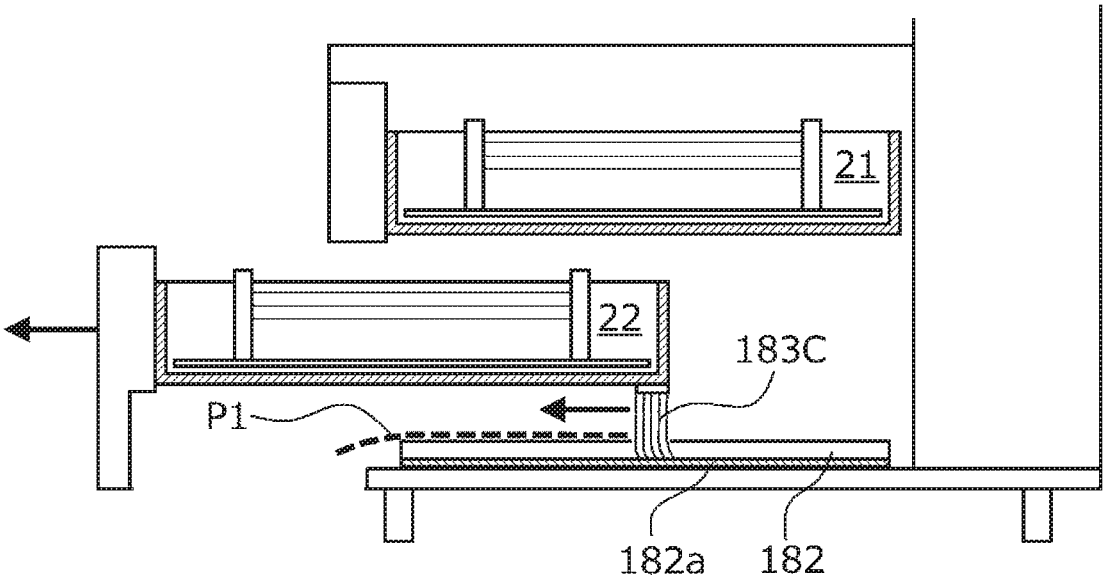
FIGS. 12A and 12B are schematic cross-sectional views, viewed from the side, of a sheet inverting unit according to a second modification example subjected to removal of a remaining sheet and a sheet guide plate subjected to cleaning.
Figure 12B:
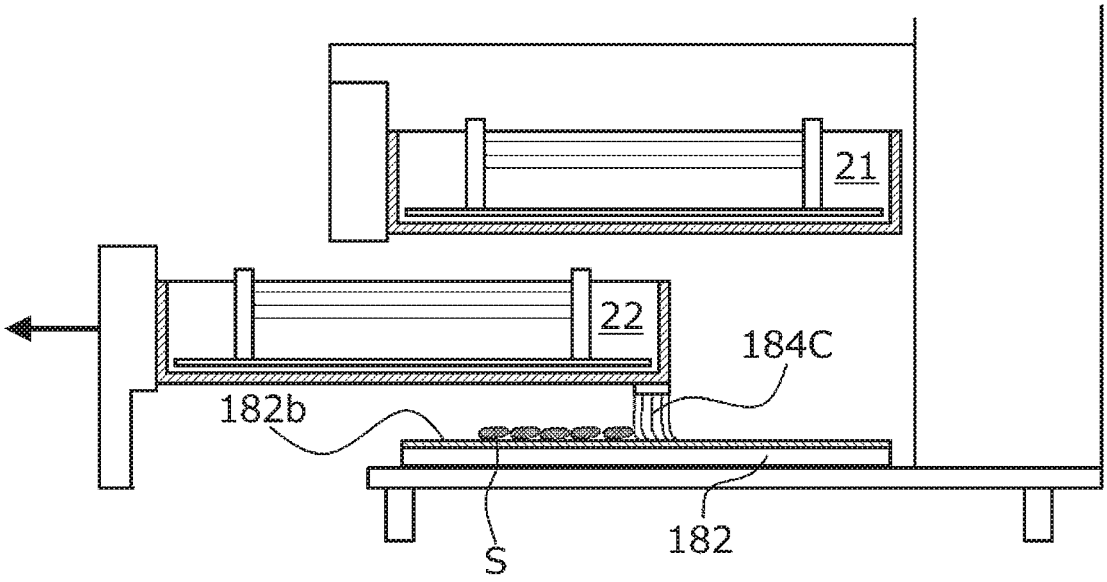

FIG. 11 is a perspective view of a sheet guide plate 182 of a sheet inverting unit 18C and a sheet tray 22 according to a second modification example viewed from the rear side of the apparatus. FIGS. 12A and 12B are schematic cross-sectional views, viewed from the side, of the sheet inverting unit 18C subjected to removal of the remaining sheet P1 and the sheet guide plate 182 subjected to cleaning.

As illustrated in FIG. 11, projections 183C and second projections 184C of the sheet inverting unit 18C according to the second modification example are formed from pile brushes. Preferable examples of pile brushes are those including piles formed from erected monofilaments of Φ0.1 to 0.2 mm. As illustrated in FIGS. 12A and 12B, such pile brushes enable the projections 183C to reliably push out the remaining sheet P1 left on the sheet guide plate 182 in association with the pull-out operation of the sheet tray 22, and enable the second projections 184C to reliably sweep off the dust S accumulating on the sheet guide plate 182 in the pull-out direction (−Y direction) of the apparatus body while the piles are in contact with the surface 182*b* of the sheet guide plate 182 without damaging the surface of the sheet guide plate 182.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

a drawer unit drawable from an apparatus body;

a sheet inverting unit that is disposed in the apparatus body, and pulls a sheet into a lower portion of the drawer unit to invert the sheet, wherein the sheet inverting unit comprises a sheet container;

a sheet guide plate that is disposed on the sheet inverting unit to face the drawer unit, the sheet guide plate including a recess extending in a pull-out direction of the drawer unit that crosses a direction in which the sheet is transported; and a projection that protrudes toward the recess from a portion of a lower surface of the drawer unit facing the sheet guide plate near a pull-out start point in the pull-out direction and on a rear of a transport area of the sheet.

2. The image forming apparatus according to claim 1, wherein the projection moves along the recess of the guide plate in association with a pull-out operation of the drawer unit toward a side from which the drawer unit is pulled out, and pushes the sheet out in the pull-out direction of the apparatus body while being in contact with an end of the sheet left in the sheet inverting unit.

3. The image forming apparatus according to claim 2, further comprising a second projection that protrudes toward the sheet guide plate from a portion of the lower surface of the drawer unit facing the guide plate near the pull-out start point in the pull-out direction and on a rear of a transport area of the sheet, wherein the second projection moves to a side from which the drawer unit is pulled while being in contact with the sheet guide plate in association with a pull-out operation of the drawer unit to clean the sheet guide plate.

4. The image forming apparatus according to claim 3, wherein the projection and the second projection are formed from elastic foam.

5. The image forming apparatus according to claim 3, wherein the projection and the second projection are formed from polyester films.

6. The image forming apparatus according to claim 3, wherein the projection and the second projection are formed from pile brushes.

7. The image forming apparatus according to claim 1, further comprising a second projection that protrudes toward the sheet guide plate from a portion of the lower surface of the drawer unit facing the guide plate near the pull-out start point in the pull-out direction and on the rear of the transport area of the sheet, wherein the second projection moves to a side from which the drawer unit is pulled while being in contact with the sheet guide plate in association with a pull-out operation of the drawer unit to clean the sheet guide plate.

8. The image forming apparatus according to claim 7, wherein the projection and the second projection are formed from elastic foam.

9. The image forming apparatus according to claim 7, wherein the projection and the second projection are formed polyester films.

10. The image forming apparatus according to claim 7, wherein the projection and the second projection are formed from pile brushes.

11. An image forming apparatus, comprising:

drawer means drawable from an apparatus body;

sheet inverting means disposed in the apparatus body, for pulling a sheet into a lower portion of the drawer means to invert the sheet;

sheet guide plate means disposed on the sheet inverting means to face the drawer means, the sheet guide plate means including a recess extending in a pull-out direction of the drawer means that crosses a direction in which the sheet is transported; and projection means that protrudes toward the recess from a portion of a lower surface of the drawer means facing the sheet guide plate means near a pull-out start point in the pull-out direction and on a rear of a transport area of the sheet.

* * * * *